US007185749B2

(12) United States Patent
Armanini et al.

(10) Patent No.: US 7,185,749 B2
(45) Date of Patent: Mar. 6, 2007

(54) CURRENCY BILL RECYCLING MACHINE

(75) Inventors: Pietro Armanini, Turin (IT); Werner Haag, Lugnorre (CH)

(73) Assignee: De La Rue International Ltd., Hampshire (GB)

( * ) Notice: Subject to any disclaimer, the term of this patent is extended or adjusted under 35 U.S.C. 154(b) by 88 days.

(21) Appl. No.: 10/501,241

(22) PCT Filed: Mar. 5, 2003

(86) PCT No.: PCT/GB03/00962

§ 371 (c)(1),
(2), (4) Date: Sep. 15, 2004

(87) PCT Pub. No.: WO03/075228

PCT Pub. Date: Sep. 12, 2003

(65) Prior Publication Data

US 2005/0011721 A1 Jan. 20, 2005

(30) Foreign Application Priority Data

Mar. 6, 2002 (GB) ..... 0205275.1

(51) Int. Cl.
*G07D 7/00* (2006.01)

(52) U.S. Cl. ..... 194/302

(58) Field of Classification Search ..... 194/302, 194/205, 215, 216

See application file for complete search history.

(56) References Cited

U.S. PATENT DOCUMENTS 4,587,408 A * 5/1986 Watanabe ..... 235/379
4,625,870 A * 12/1986 Nao et al. ..... 209/534
4,795,889 A * 1/1989 Matuura et al. ..... 235/379
5,553,320 A * 9/1996 Matsuura et al. ..... 235/379
5,555,983 A 9/1996 Yamagishi
6,128,402 A * 10/2000 Jones et al. ..... 382/135
6,334,610 B1 1/2002 Minamishin et al.
6,942,207 B2 * 9/2005 Katou et al. ..... 271/3.01
2002/0003163 A1 * 1/2002 Peebles et al. ..... 235/379

FOREIGN PATENT DOCUMENTS

EP 0 317 537 A2 5/1989
EP 0 734 001 A2 9/1996
EP 0.967.581 A2 * 12/1999

* cited by examiner

*Primary Examiner*—Patrick Mackey
*Assistant Examiner*—Mark J. Beauchaine
(74) *Attorney, Agent, or Firm*—Oliff & Berridge PLC

(57) ABSTRACT

A currency bill recycling machine has an input (3) and output (8, 9) for receiving and dispensing currency bills; a transport system (4); and a detection system (5) to which bills are fed by the transport system from the input (3). The detection system (5) is adapted to determine the denomination, authenticity and fitness of each bill. A recycling store (11–14) and an unfit bill store (15) are provided to which bills are fed by the transport system (4). The detection system (5) is adapted to cause genuine fit bills to be fed to the recycling store (11–14), and to cause unfit bills to be fed to the unfit bill store (15), the transport system being operable to withdraw bills from the recycling store for dispensing via the output (8, 9).

11 Claims, 4 Drawing Sheets

CURRENCY BILL RECYCLING MACHINE

The invention relates to a currency bill recycling machine allowing currency bills to be deposited and recycled for dispensing.

Currency bill recycling machines are often used for teller assist purposes. They relieve the teller of the need to check deposited bills for authenticity and denomination and typically bills which cannot be authenticated or denominated are immediately returned to the teller who can then return them to the customer, destroy them or the like. The De La Rue TCR Twin Safe is a recent example of such a teller assist recycling machine.

Problems can arise, however, when currency bills of poor condition or fitness are offered for deposit. These may be unfit for a variety of reasons such as undue soiling, tears, corner folds and the like. Conventionally, it has been necessary for the teller to manually prevent these bills from being fed into the recycling machine where they are likely to cause jams. However, some currency bills may be sufficiently fit to pass a visual test but nevertheless are not acceptable for recycling. In addition, manually inspecting bills when presented in a bundle is particularly difficult for a teller who must do this quickly.

Fitness detectors are well known but typically are only utilized in large scale sorting machines. An example of a recycler which carries out a fitness test is described in US-A-2001/0015309. In this machine, bills are tested for authenticity, denomination and fitness. However, if an unfit (or counterfeit) bill is detected then it is immediately sent back to an output. This is unsatisfactory from the point of view of both a customer and a teller because it is then necessary to manually check the returned bill to determine whether it has been rejected on grounds of genuineness or fitness and it is particularly undesirable for unfit but genuine notes to be returned.

Other examples are described in EP-A-0734001, EP-A-0317537, U.S. Pat. No. 5,555,983 and U.S. Pat. No. 6,334,610.

In all these cases, no attention has been paid to the variety of bills classified as unfit.

In accordance with the present invention, a currency bill recycling machine has an input and output for receiving and dispensing currency bills; a transport system; a detection system to which bills are fed by the transport system from the input, the detection system being adapted to determine at least the fitness and authenticity of each bill; and a recycling store, a recirculation store, and an unfit bill store to each of which bills are selectively fed by the transport system, the detection system being adapted to cause genuine bills of sufficient fitness for recycling to be fed to the recycling store, to cause genuine bills of sufficient fitness for recirculating but not recycling to be fed to the recirculation store, and to cause unfit bills to be fed to the unfit bill store, the transport system being operable to withdraw bills from the recycling store for dispensing via the output.

We have developed a modified form of currency bill recycling machine in which unfit bills are not fed back to the output but rather are fed to an unfit bill store which enables the bills to be accepted but prevents them from being recycled. In addition, we have recognised that a distinction can be drawn between bills unfit for recirculation and those which can be recirculated but are not sufficiently fit to be recycled.

In particular, certain bills which are sufficiently fit for recirculation are not fit for recycling either by the same or a different recycling machine, particularly if they are unduly limp. It is possible to sort genuine bills, in accordance with their degree of fitness, between the recycling store and the recirculation store. By providing the recirculation store, these non-recyclable fit bills can be neatly stacked in the store using a conventional stacking mechanism such as a stacking wheel or roll storage module.

Typically, the unfit bill store will comprise a simple storage bin or the like into which the unfit bills are dropped or otherwise fed without being positively stacked. A problem which has arisen in the past is that a stacking mechanism such as a stacking wheel or roll storage module has jammed when presented with certain types of unfit bill, for example having a tear or corner fold.

Typically, the detection system is adapted to determine one or both of the denomination and authenticity of each bill.

In a particularly preferred aspect of the invention, the machine further comprises an additional, stacking store, the detection system being adapted to cause genuine bills which are not sufficiently fit for recycling by the machine to be fed to the additional, stacking store.

It will be appreciated that although we have referred so far to the use of a single recycling store, a single recirculation store and a single unfit bill store, there could, of course, be more than one of each, particularly, in the case of recycling stores, one for each different denomination to be handled.

In some cases, the or each recycling store will be utilized solely within the currency bill recycling machine but in other cases, one (or more) of the recycling stores may be removable from the machine for use with another bill dispensing machine such as an ATM. This has the advantage that bills can be immediately made ready for dispensing without the need for separate sorting processes to be carried out.

The detection system may utilize any conventional components for determining fitness and optionally authenticity and denomination of the bills, typically including pattern and/or size recognition for denomination; magnetic, IR or UV detection for authenticity; and image processing and/or acoustic limpness detection for fitness.

As explained above, the currency bill recycling machine according to the invention is particularly useful for use as a teller assist machine but could be used in conventional, non-teller applications also.

An example of a teller assist currency bill recycling machine according to the invention will now be described with reference to the accompanying drawings, in which.

Figure 1:
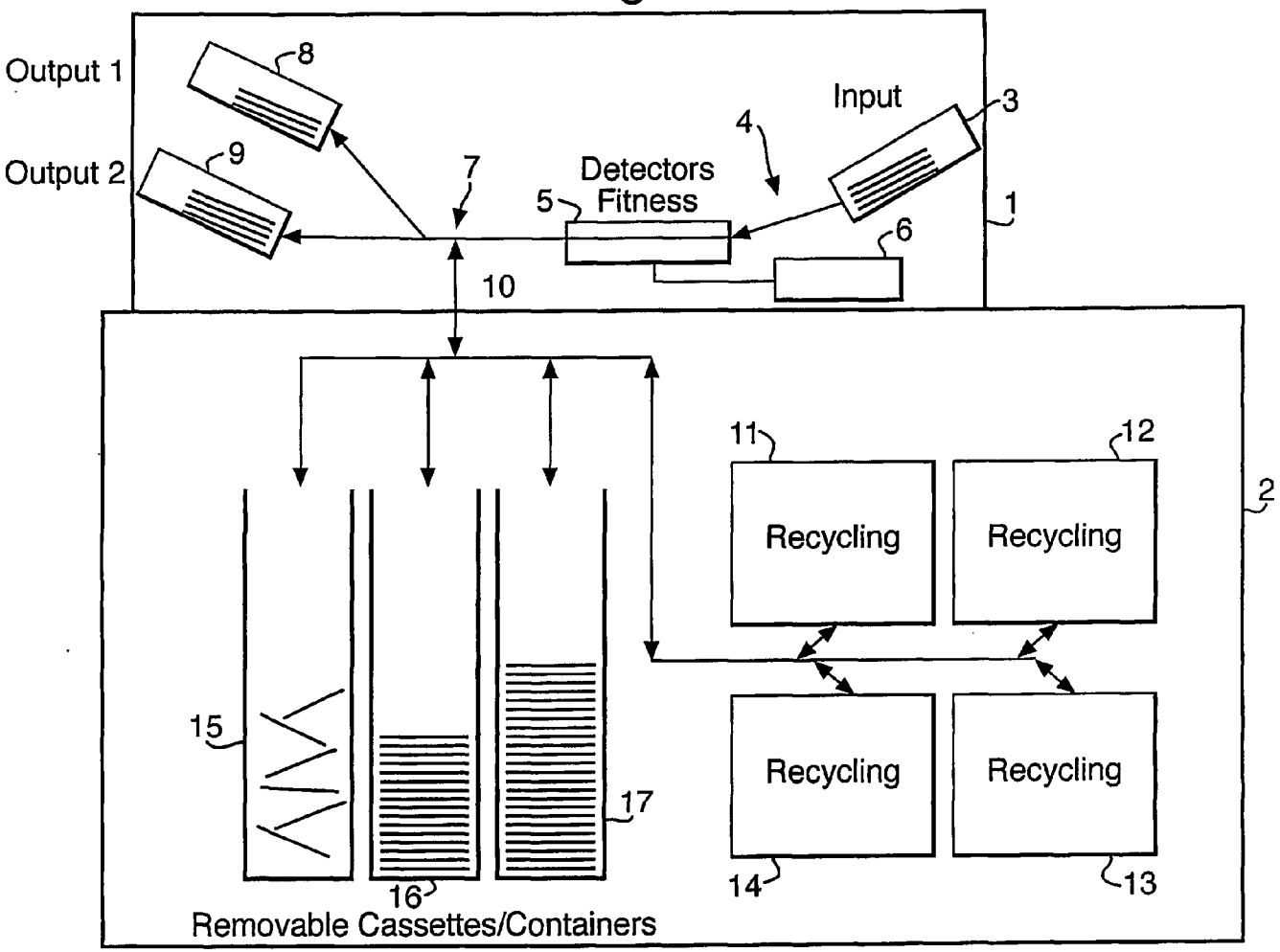
FIG. 1 is a schematic diagram of the major components of the machine.

The teller assist machine shown in FIG. 1 has two primary components, a bill or note handling module (NHM) 1 mounted on top of a banknote storage module 2 located within a secure housing such as a safe. The NHM 1 includes an input station 3 from which notes are fed singly by a transport system generally designated 4 to a detection system 5. The detection system 5 includes a microprocessor 6 which not only controls the performance of the detection system but also the transport system and diverters within the transport system. Notes are fed by the transport system 4 from the detection system 5 to a diversion point 7 where the notes can either be fed to one of a pair of output stations 8,9 conveniently located adjacent respective tellers or through a slot 10 in the housing of the module 2.

From the slot 10, the notes can be fed either to one of a set of four recycling stores 11–14 or to one of a set of three cassettes or containers 15–17.

The detailed construction of the transport system and diverters as well as the stores will not be described in detail since these are all conventional in themselves and will be well understood by persons of ordinary skill in the art. Indeed, the overall system is based closely on the De La Rue TCR Twin Safe machine.

Figure 2:
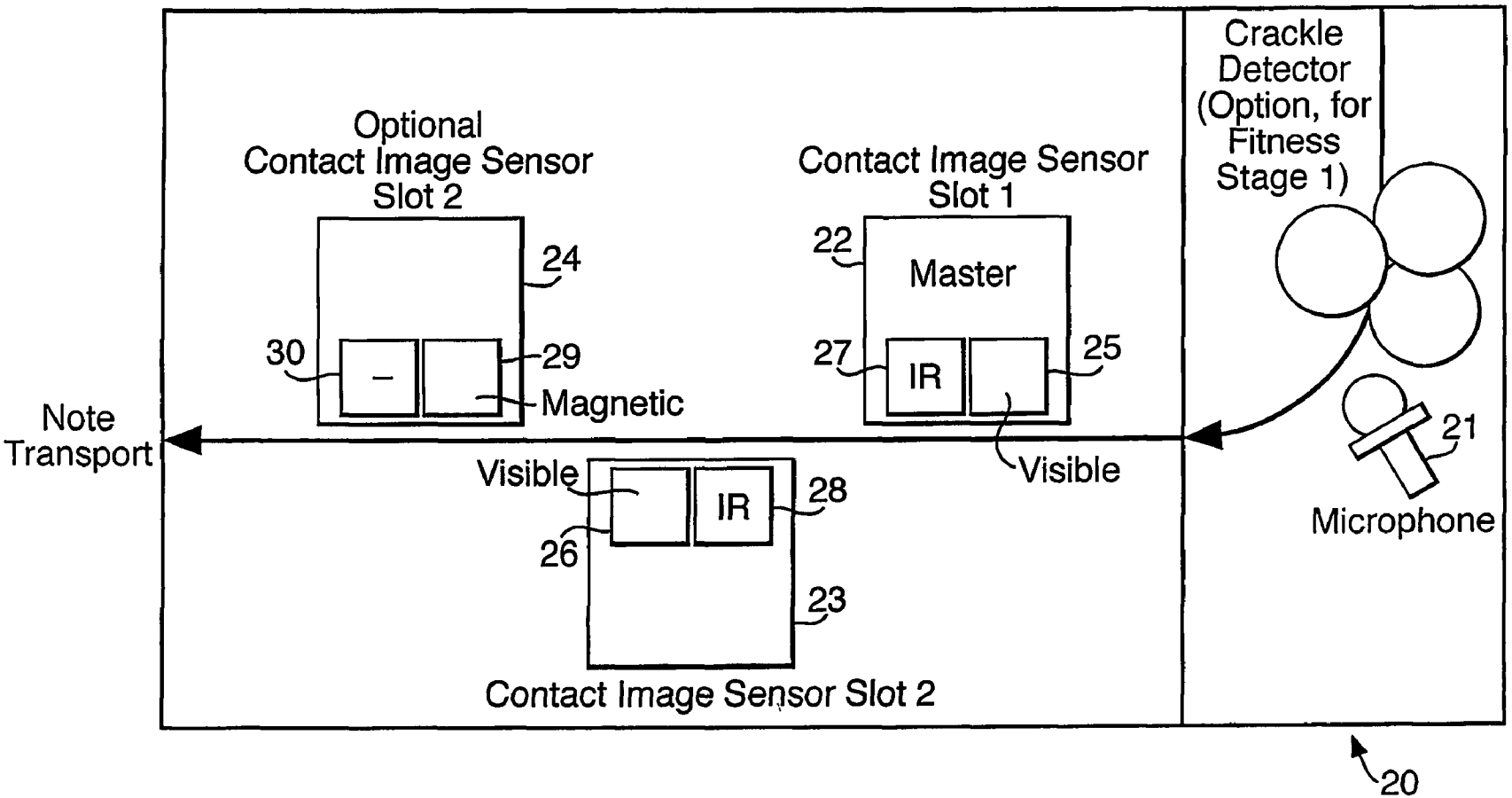
FIG. 2 illustrates the detection system in more detail.

The detection system 5 is shown in more detail in FIG. 2. Notes are first fed through an acoustic limpness or crackle detector 20 in which they are bent around a 90° angle as they pass along the transport path and as they bend, they will emit a sound or crackle which is detected by a microphone 21. The amplitude of this sound is then passed from the microphone 21 to the microprocessor 6. The notes then pass a set of three sensor assemblies 22,23,24 which inspect the notes as will be described in more detail below. Each of the sensor assemblies 22–24 is connected to the microprocessor 6.

The microprocessor 6 determines from the information supplied from the sensor assemblies 22–24 and acoustic limpness detector 20 the denomination, genuineness and fitness of each note. The visible appearance of the note is detected in response to visible irradiation from sensors 25,26 in the assemblies 22,23 respectively from which visual images of the appearance of each side of the note are obtained and stored, an example being shown in FIG. 3. In other examples, the appearance of only one side is determined. After normalization and correction for skew and the like, the images are then used to determine denomination by virtue of the note size or, in more sophisticated examples, by carrying out a pattern recognition process in which the image is compared with a set of known patterns so as to determine denomination. This is indicated by steps 40,41 in FIG. 4.

For the purposes of determining authenticity, each side of the note (although in some cases only one side of the note need be inspected) is irradiated with infrared radiation, the response to that irradiation being sensed by sensors 27,28 in assemblies 22,23 respectively. Again, a pattern can be built up which can then be compared with known patterns of genuine notes. Conveniently, the denomination processing is carried out first to limit the patterns which need to be used for authentication.

Optionally, a further magnetic, authentication test may be made using a magnetic sensor 29 in the assembly 24. These steps are again indicated by steps 40 and 41 in FIG. 4.

Figure 3:
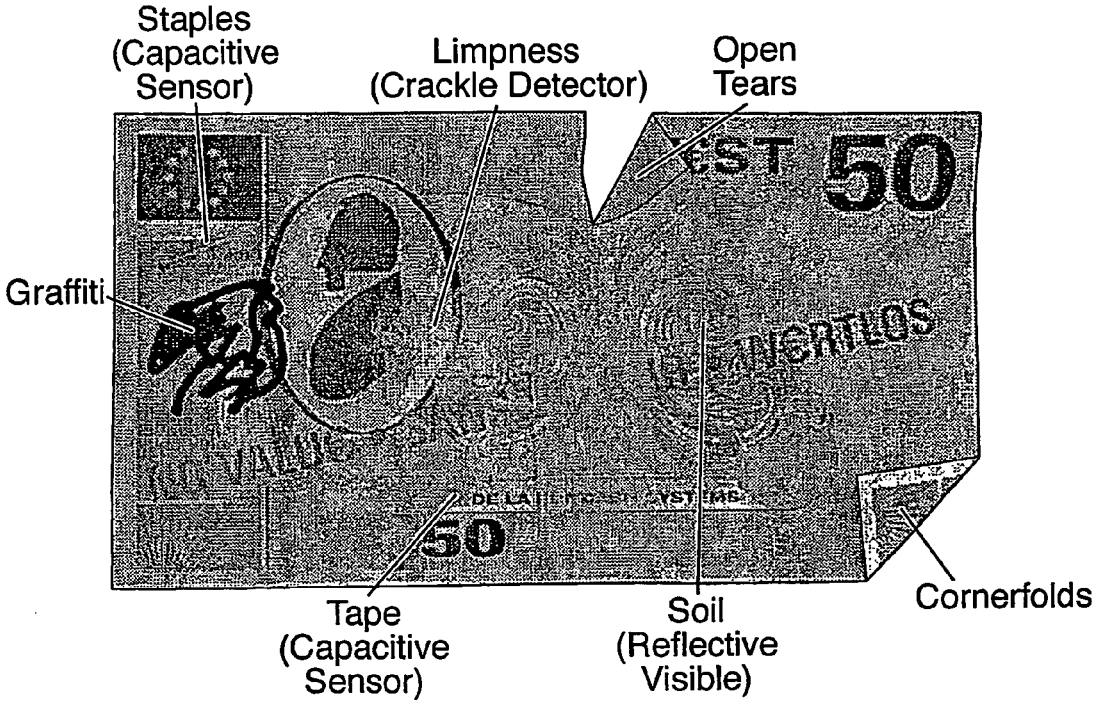
FIG. 3 illustrates a representation of a currency bill having a number of unfit properties; and, FIG. 4 is a block diagram illustrating the processing algorithm performed by the detection system.

The microprocessor 6 also utilizes the IR and visible image data to determine the fitness of the note. Fitness criteria which can be assessed include physical damage (open and closed tears), folds (dog ears, Z folds, side folds), crumples, stains, written or drawn visual modifications ("graffiti"), soil and foreign objects (tape, staples, paperclips). Some of these are indicated at FIG. 3 and it will be noted that for some, it is useful to include a capacitive sensor 30. In addition, the limpness of the notes can be assessed using the acoustic limpness detector 20. These processes are indicated at steps 42,43 in FIG. 4.

As a result of steps 42,43, a fitness decision can be made (step 44) so as to assess firstly whether the note is fit or unfit and then whether a distinction can be made between recyclable and non-recyclable (but reusable) genuine and fit notes. The distinction is based on a statistical analysis of the distribution of the estimated fitness criteria on a training population of real currency. In addition, a user-dependent threshold may be used to bias the decision towards a more or less critical behaviour. This is because fitness criteria typically do not permit a clear distinction between the classes, and decisions should be tuned in order to match as closely as possible the subjective perception of the individual human operator.

The user-dependent thresholds applied by the fitness decision algorithm are determined empirically.

Figure 4:
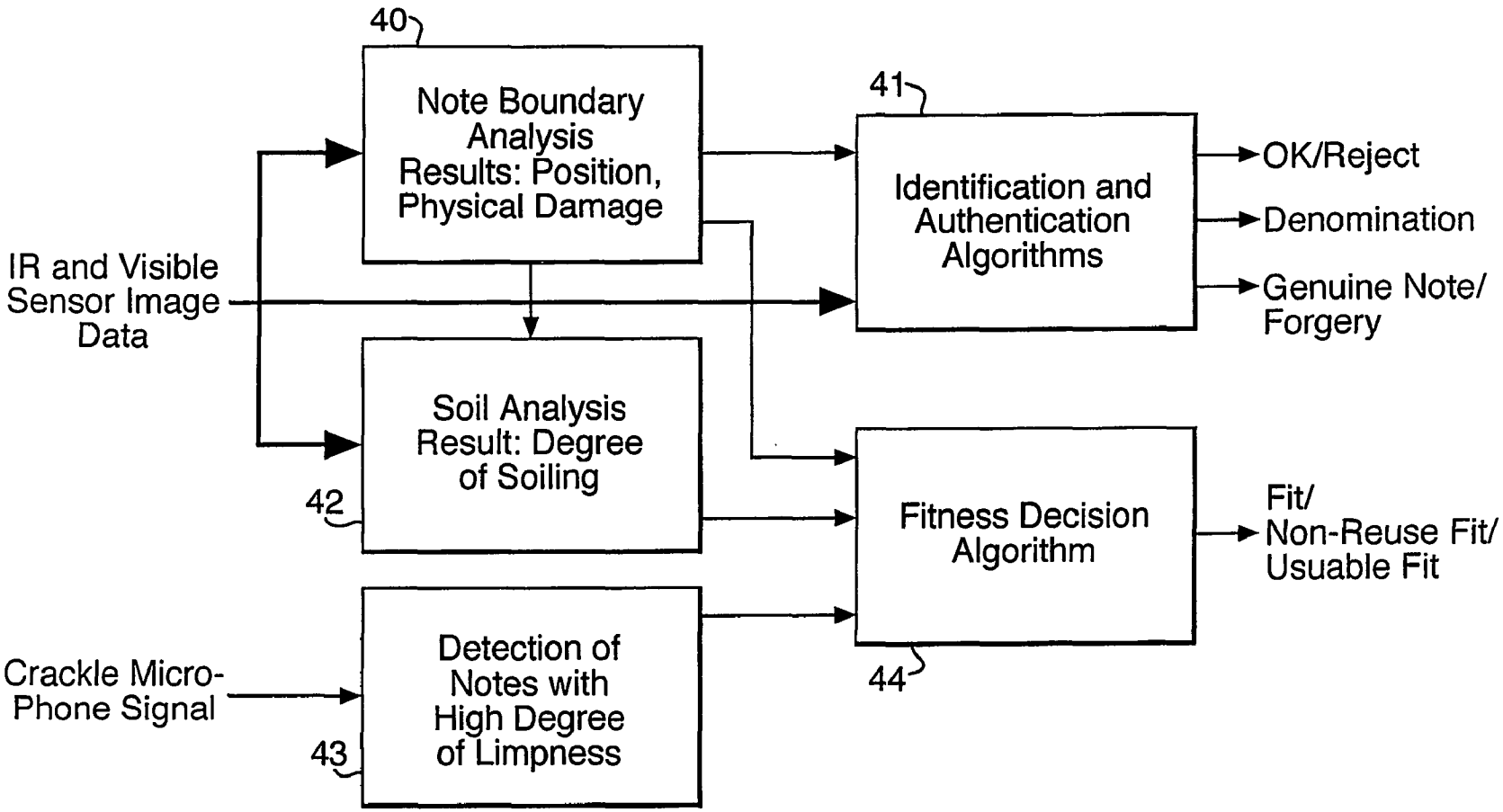

Ultimately, as can be seen in FIG. 4, the microprocessor 6 will make a decision on denomination, authenticity and fitness and issue a routing signal accordingly. It will also increment counts relating to the number of notes of each denomination, typically broken down between fit and unfit.

Non-genuine notes are fed immediately to one of the outputs 8,9.

Recyclable (i.e genuine and of sufficient fitness) notes are directed by the transport system 4 to an appropriate one of the recycling stores 11–14 from where they can be recycled when the machine is used for dispensing. Each of the stores 11–14 can comprise a roll storage module or stacking cassette (with stacking wheel) as is well known.

Genuine, identified notes which are fit enough for recirculation but not recycling are stacked in one of a pair of cassettes or recirculation stores 16,17, while genuine but unfit notes are dropped into a store 15. The store 15 does not include any stacking mechanism since it would be difficult to store unfit notes, particularly limp notes and they are simply dropped into the store 15.

Conveniently, the stores 11–14 are removable so that they can be located in another dispensing machine such as an ATM. The stores 15–17 may be fixed in position or removable.

When the teller wishes to dispense notes, he will enter the required combination of denominations via an input device (not shown) and the microprocessor 6 will operate the transport system to extract the required combination of notes from appropriate recycling stores 11–14 where they are fed through the slot 10 to the appropriate output 8,9.

In some modes, the machine can sort notes from the input 3 directly to the outputs 8,9, so as simply to separate fit and unfit notes optionally independent of denomination and/or authenticity.

The invention claimed:

1. A currency bill recycling machine having an input and output for receiving and dispensing currency bills;

a transport system;

a detection system to which bills are fed by the transport system from the input, the detection system that determines at least the fitness and authenticity of each bills, the fitness of a bill being determined as sufficient for recycling when the detection system determines that the bill can be reliably dispensed by the currency bill recycling machine, the fitness of the bill being determined as sufficient for recirculating but not recycling when the dispensing system determines that the bill is degraded such that the bill cannot be reliably dispensed by the currency bill recycling machine but can be further used in commerce, the fitness of the bill being determined as unfit when the detection system determines the bill is sufficiently degraded that the bill is unusable in commerce; and a recycling store, a recirculation store, and an unfit bill store to each of which bills are selectively fed by the transport system, the detection system being adapted to cause genuine bills of sufficient fitness for recycling to be fed to the recycling store, to cause genuine bills of sufficient fitness for recirculating but not recycling to be fed to the recirculation store, and to cause unfit bills to be fed to the unfit bill store, the transport system being operable to withdraw bills from the recycling store for dispensing via the output.

2. A machine according to claim 1, wherein the detection system is adapted to cause non-genuine bills to be fed to the output.

3. A machine according to claim 1, wherein the output and input are formed by separate openings.

4. A machine according to claim 1, wherein the recycling store comprises a roll storage module or a cassette and stacking system.

5. A machine according to claim 1, wherein the recirculating store comprises a bin into which recirculable bills are dropped.

6. A machine according to claim 1, wherein the unfit bill store comprises a bin into which rejected bills are dropped.

7. A machine according to claim 1, wherein the recycling store is removable from the machine for use with another bill dispensing machine such as an ATM.

8. A machine according to claim 1, wherein the detection system is adapted to determine the denomination of each bill.

9. A machine according to claim 1, wherein the stores are contained within a secure housing.

10. A machine according to claim 1, the machine having more than one output store, the transport system being controllable to feed bills directly from the input to the output stores via the detection system without being fed to the recycling and/or unfit bill stores.

11. A machine according to claim 1, the machine being constructed as a teller assist machine.

* * * * *